US005992873A

United States Patent [19]

Hauglin

[11] Patent Number: 5,992,873

[45] Date of Patent: Nov. 30, 1999

[54] ARRANGEMENT FOR A CROSS-COUNTRY SKI BINDING IN PARTICULAR A SKATING BINDING

[75] Inventor: Bernt Otto Hauglin, Røyken, Norway

[73] Assignee: Rottefella AS, Klokkarstua, Norway

[21] Appl. No.: 08/973,628

[22] PCT Filed: Apr. 19, 1996

[86] PCT No.: PCT/IB96/00356

§ 371 Date: Dec. 5, 1997

§ 102(e) Date: Dec. 5, 1997

[87] PCT Pub. No.: WO96/39233

PCT Pub. Date: Dec. 12, 1996

[30] Foreign Application Priority Data

| | | | |
|---|---|---|---|
| Jun. 6, 1995 | [DE] | Germany | 195 20 615 |
| Jun. 20, 1995 | [DE] | Germany | 195 22 343 |

[51] Int. Cl.[6] ..... A63C 9/10

[52] U.S. Cl. ..... 280/615; 280/613; 280/631

[58] Field of Search ..... 280/615, 613, 280/614, 623, 626, 631

[56] References Cited

U.S. PATENT DOCUMENTS

| | | | |
|---|---|---|---|
| 2,246,153 | 6/1941 | Wallace | 280/614 |
| 4,032,172 | 6/1977 | Pyzel et al. | 280/615 |
| 4,410,200 | 10/1983 | Näpflin | 280/615 |
| 4,659,103 | 4/1987 | Tessaro | 280/615 |
| 4,768,805 | 9/1988 | Graillat | 280/615 |
| 4,787,155 | 11/1988 | Callegari | 280/615 |
| 4,836,572 | 6/1989 | Pozzobon | 280/615 |
| 4,945,658 | 8/1990 | Provence | 280/615 |
| 5,048,855 | 9/1991 | Girault et al. | 280/615 |
| 5,228,714 | 7/1993 | Dekanovsky | 280/615 |
| 5,236,217 | 8/1993 | Provence | 280/615 |
| 5,282,642 | 2/1994 | Provence | 280/615 |
| 5,338,053 | 8/1994 | Haughlin | 280/615 |
| 5,499,838 | 3/1996 | Haughlin et al. | 280/615 |
| 5,518,264 | 5/1996 | Broughton | 280/615 |
| 5,595,396 | 1/1997 | Bourdeau | 280/615 |
| 5,664,797 | 9/1997 | Haughlin | 280/615 |
| 5,671,941 | 9/1997 | Girard | 280/615 |
| 5,727,808 | 3/1998 | Broughton | 280/615 |
| 5,794,963 | 8/1998 | Girard | 280/615 |

FOREIGN PATENT DOCUMENTS

| | | |
|---|---|---|
| 0 586 365 A1 | 8/1993 | European Pat. Off. . |
| 1240519 | 12/1960 | France . |
| 41 03 878 A1 | 10/1991 | Germany . |
| 41 12 979 A1 | 10/1992 | Germany . |
| 43 43 485 C1 | 3/1995 | Germany . |
| 44 28 154 A1 | 3/1995 | Germany . |
| WO 84/03225 | 8/1995 | WIPO . |
| WO 96/23558 | 8/1996 | WIPO . |

*Primary Examiner*—Lanna Mai
*Assistant Examiner*—Andrew J. Fischer
*Attorney, Agent, or Firm*—Zarley, McKee, Thomte, Voorhees & Sease

[57] ABSTRACT

Arrangement of a cross-country, particularly skating binding (15) and a shoe (16) adapted thereto, which has on its forward sole (12) complementary engagement members introducible into engagement members of the binding in order to produce a joint-like connection, the engagement members on the sole comprising a bracket (11) extending transversely to the longitudinal direction of the sole and roughly parallel to the tread surface of the sole and located off-set relative to the forward sole end, and the complementary engagement members on the binding comprising a retaining hook engaging over the bracket (11), particularly from behind, which is movable from a closed position into a release position and vice-versa. The retainer hook (6) is movable out of the closed position into the release position by means of an actuating device (3, 4) coupled therewith, against the action of a member, particularly a resilient member (5) initially resiliently tensioning it in a forward direction.

12 Claims, 2 Drawing Sheets

ARRANGEMENT FOR A CROSS-COUNTRY SKI BINDING IN PARTICULAR A SKATING BINDING

SPECIFICATION

Figure 1:
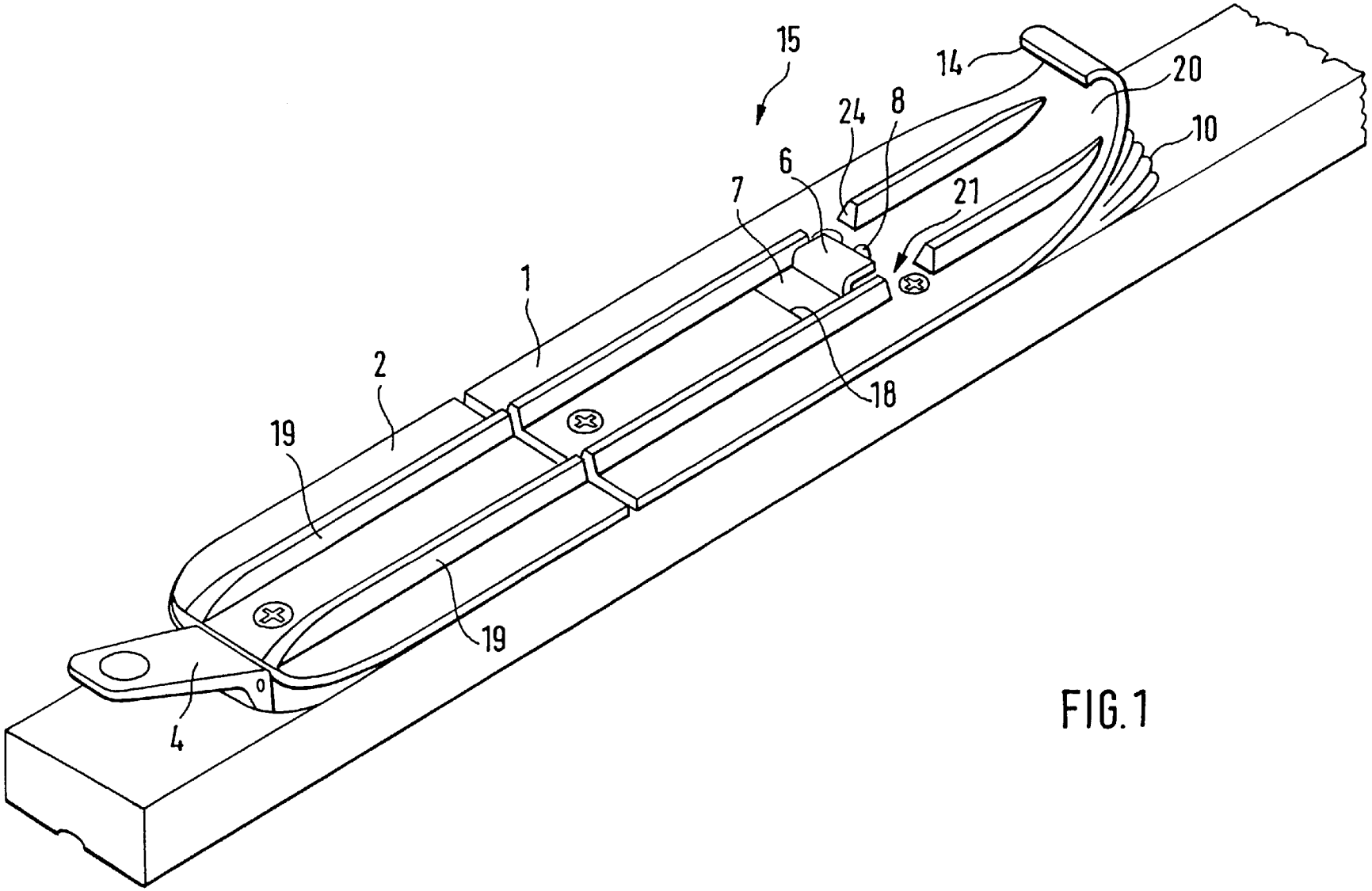

The invention relates to the arrangement of a cross-country, particularly skating binding and a shoe adapted thereto, which has on its forward sole complementary engagement members introducible into engagement members of the binding in order to produce a joint-like connection, the engagement members on the sole comprising a bracket extending transversely to the longitudinal direction of the sole and roughly parallel to the tread surface of the sole and located off-set relative to the forward sole end, and the complementary engagement members on the binding comprising a retaining hook engaging over the bracket, particularly from behind, which is movable from a closed position into a release position and vice-versa.

Such an arrangement is known from DE 43 43 485 C1. This known arrangement is characterised by a simple and compact construction. In addition, it ensures exact ski guidance and maximum power transmission even during so-called "skating. Thus in the known construction an essential factor is not only the arrangement of the joint axis in the ball region of the forward shoe sole, but also the arrangement of a resilient contact member in the region of the joint axis between the sole and the ski cover surface.

A quite similar construction is disclosed in DE 44 28 154 A1.

A disadvantage in the known arrangement, which is ascribed to the same inventor as the present invention, is the lack of reliability in handling when stepping into or out of the binding.

Therefore the object underlying the present invention is to improve the reliability of handling of the edge arrangements. In particular it is to be ensured that, during use, the retaining hook remains in a closed position even under alternating and heavier loads.

This object is achieved by the characterising features of claim 1. By virtue of the fact that the retaining hook is initially tensioned in the closed position it is ensured that this latter remains in the closed position even under alternating and heavier loads. The retaining hook can be brought into its release position contrary to the initial tension. Particularly advantageous constructive embodiments therefore are described in claims 9 and 10, to which reference is particularly made here. Accordingly, in a preferred embodiment, there engages on the retainer hook a clamp cable, which is preferably led round behind the heel of the shoe, and upon which a clamp lever engages in such a way that by depressing the latter, the clamp cable is drawn backwards, correspondingly carrying with it the retainer hook contrary to the action of the resilient members initially tensioning it in the closed position. This construction applies for a retainer hook which engages over the bracket integrated with the sole from behind.

Insofar as the construction is so designed that, in order to produce a joint-like connection between shoe and binding, the retaining hook engages over the bracket integrated with the sole from the front, the clamp cable engaging on the retaining hook is oriented forwards, and coupled with a clamp lever mounted to pivot in front of the shoe in such a way that when the clamp lever is depressed, the clamp cable is drawn forwards, correspondingly taking with it the retaining hook contrary to the action of a member initially tensioning the latter in a backward direction.

Insofar as the binding is constructed as a so-called "step-in binding, the retaining hook is held in its release position by a retaining member which may be acted on by the bracket on the sole when stepping into the binding in such a way that, when the retaining member is acted upon, the retaining hook is released for movement into the closed position. For this purpose, there is preferably arranged on the upper side of the retaining member a projection, e.g. a pin or the like, corresponding with the bracket on the sole when stepping into the binding. This projection is initially acted upon when stepping into the binding by the sole bracket and pressed downwards. In this way the retaining member is released from the retaining hook, so that the latter, due to the resilient initial tension, can move into the closed position.

The retaining member is preferably a projection initially resiliently tensioned upwards within a binding housing, and corresponding with the retaining hook. The retaining member is preferably a resiliently upwardly initially tensioned leaf spring made of plastic or metal (spring steel).

In combination with, but also independently of the arrangement described above, there may be associated with the forward sole end a support shell, via which the forward sole end is supported on a flexor. The forward sole end may preferably be hookable on to the support shell. For this purpose the forward end of the support shell can have a projection extending obliquely backwards and downwards, which corresponds by means of a relevant recess, particularly a groove, on the forward sole end for purposes of the said hooking operation. Thus the shoe is connected with the binding both at the foremost end of the sole and also further backwards, particularly in the ball area, the joint movement being ensured by the said flexor between the ski cover surface and the said support shell.

Like the binding housing, the support shell consists of weather-resistant plastic. It is preferably an integral extension in the forward direction of the binding housing. It is of a thin-walled design such that the flexibility of the flexor is not or only slightly impaired thereby.

Figure 2:
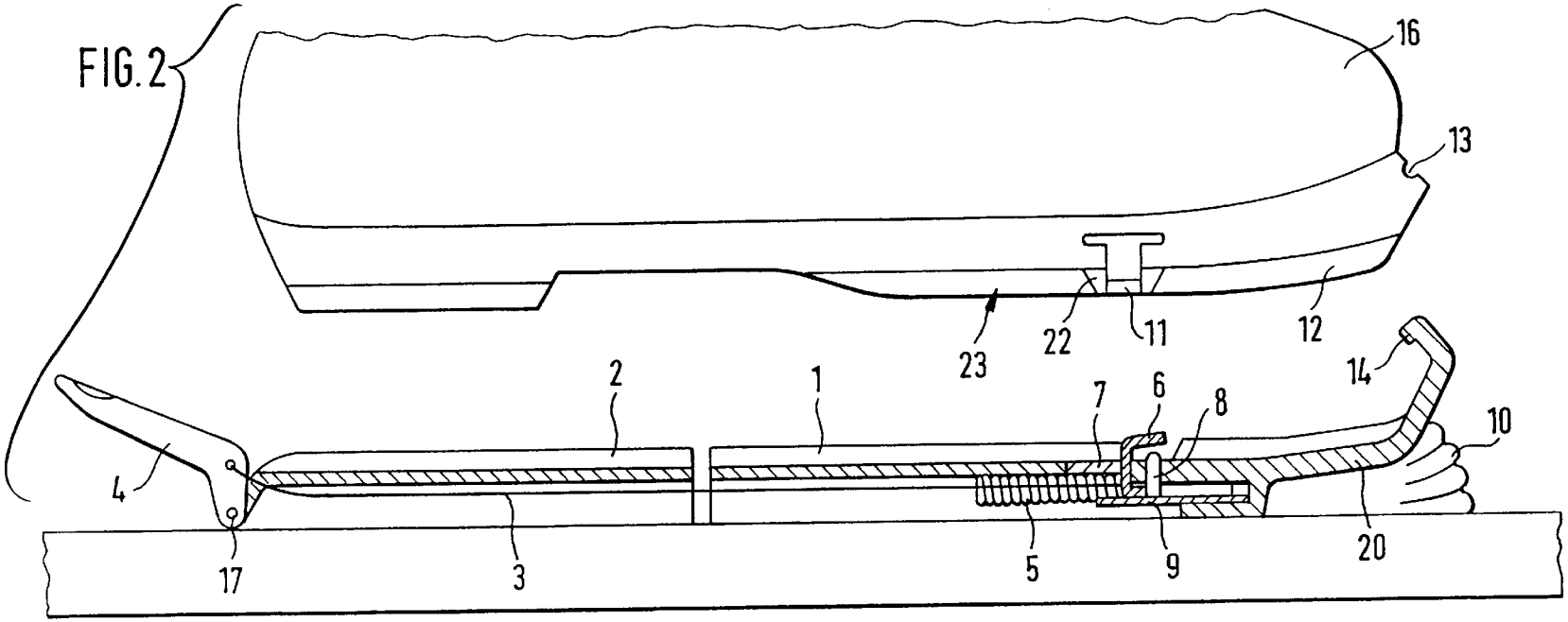
Figure 3:
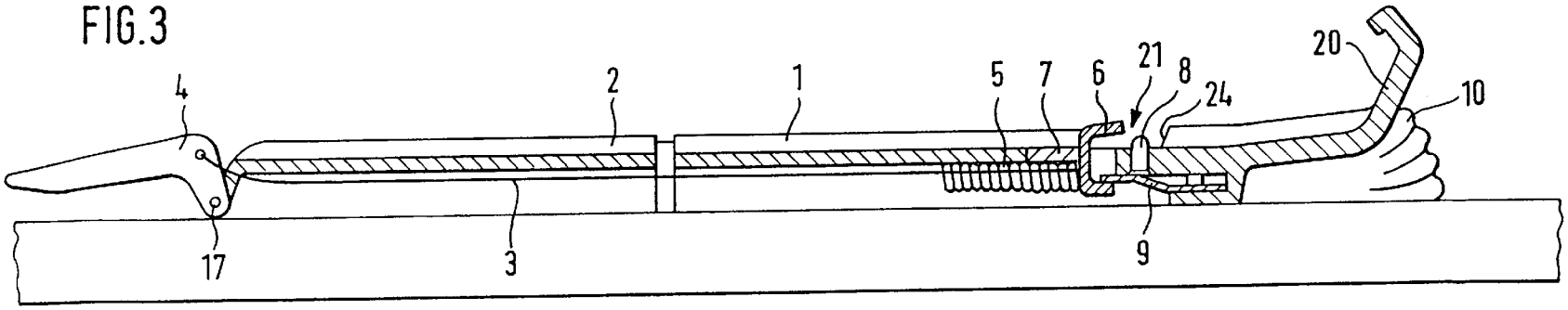

An embodiment given by way of example of a shoe binding arrangement will be explained in more detail in the following with reference to the annexed drawing, which shows:

FIG. 1: a binding for an arrangement according to the invention in schematic perspective view from obliquely behind and above;

FIG. 2: the binding arrangement according to FIG. 1 in partial view, partially in cross-section in association with a ski shoe, the retaining member on the binding being in the closed position; and FIG. 3: the binding arrangement according to FIG. 2, the retaining hook being in the released position.

FIG. 1 shows a cross-country, particularly skating binding 15 in a schematic perspective view. Part of the associated shoe 16 is shown in FIG. 2. Accordingly, binding 15 and shoe 16 complement one another in a mutually corresponding arrangement, the shoe having on its forward sole 12 complementary engagement members introducible into engagement members of the binding in order to produce a joint-like connection. The sole engagement members on the shoe comprise a bracket 11 off-set to the rear relative to the forward sole end located in particular roughly in the ball area, and extending transversely to the longitudinal direction of the sole and roughly parallel to the tread surface. The complementary engagement members on the binding have a retaining hook 6 engaging from behind over the said bracket 11 (in the embodiment shown here), said hook 6 being movable out of a closed position corresponding to FIG. 2 into a release position corresponding to FIG. 3 and vice-versa. The retainer hook 6 is movable by means of an actuating device 3, 4 coupled therewith against the action of a resilient member 5 initially resiliently tensioning it in a forward direction, out of the closed position according to FIG. 2 into the release position according to FIG. 3. In the release position, the retainer hook 6 is held by a retainer member 8, 9 which can be acted on, upon stepping into the binding, by the bracket 11 integrated with the sole in such a way that the retainer member 8, 9 is acted upon from above, and the retainer hook 6 is released for movement into the closed position according to FIG. 2. In the present case, the retainer member is a resiliently upwardly initially tensioned leaf spring 9, on the upper side of which a pin-like projection 8 is located, which corresponds, upon stepping into the binding, with the bracket 11 integrated in the sole. The pin 8 may be rigidly connected to the leaf spring 9 or may be integrally designed therewith. Alternatively it is also possible to design the pin 8 separately from the leaf spring 9. In this case the pin 8 is mounted to move longitudinally within the upper cover of the binding housing forward end section 1 in such a way that it abuts on the upper side of the portion of the leaf spring extending within the binding housing. In order to prevent the pin 8 from falling out of the forward end section 1 or the bearing opening located there, the pin 8 is provided inside the housing with an annular collar, the external diameter of which is greater than the internal diameter of the bearing opening associated with the pin 8. When stepping into the binding, in which the retainer hook 6 is located in the retracted release position according to FIG. 3, the pin-like projection 8 is pressed downwards by the bracket 11 integrated with the sole. In a corresponding way the leaf spring 9 clamped with its forward end in the binding housing moves downwards and releases the retainer hook 6, so that this latter is pressed by the resilient member 5 forwards into the closed position, corresponding to FIG. 2. The resilient members 5 can be two helical pressure springs located next to one another, which are supported on the retainer hook 6 at one end and on the binding housing forward end section 1 at the other end. In order to be able to move the retainer hook 6 out of the closed position according to FIG. 2 into the release position according to FIG. 3, on both sides of the binding housing the retainer hook 6 is engaged by a clamp cable 3 which is coupled behind the heel with a clamp lever 4. For this purpose the clamp lever 4 is mounted to pivot at the rear end of end section 2, about an axis 17 extending parallel to the cover surface and transversely to the longitudinal direction of the sole. As FIG. 3 shows in comparison with FIG. 2, by compression of the clamp lever 4 the clamp cable 3 is drawn backwards, also carrying with it the retainer hook 6, against the action of the resilient member 5 initially tensioning the retainer hook 6 in the forward direction. The retainer hook 6 is drawn backwards until the leaf spring 9 springs upwards into a position corresponding to FIG. 3. If then the clamp lever 4 is let go, the resilient members 5 press the retainer hook 6 forwards, until it comes into contact with the rear end of the leaf spring 9. In this position the retainer hook 6 is held in the release position by the leaf spring 9.

Behind the retainer hook 6 in the housing forward end section 1 there is left free or opened out an incision 18, in order to enable the described to-and-fro movement of the retainer hook 6 within the binding housing. In order to prevent the penetration of dirt, snow or ice into the binding housing 1 through the said incision 18, there is located at the rear end of the retainer hook 6 a platelet-like cover 7, which moves along with the retainer hook 6 and closes the said incision in any relative position of the retainer hook 6.

There are also formed on the upper side of the binding housing sections 1, 2 two guide ribs 19 extending parallel to the longitudinal direction of the ski and at a spacing apart, which correspond with complementary guide grooves on the underside of the sole of the shoe 16.

The bracket 11, as already stated, is integrated in the ball area of the forward sole 12, i.e. within a sole recess, as shown and described in the document DE 43 43 485 C1 already mentioned.

By means of the retainer hook 6, the shoe is secured backwards, above and to the side. The forward support is effected by a support shell 20 associated with the forward sole end which is formed as an integral extension of the binding housing forward end section 1. Located and effective between the support shell 20 and the ski cover surface is a resiliently flexible member, i.e. a flexor 10. The forward sole end is thus supported via the said support shell 20 on the flexor 10, the associated pivotal axis being defined by the interaction of the bracket 11 integrated with the sole and the retainer hook 6 on the binding.

In order to prevent the shoe from slipping forwards out of the binding, the forward end of the support shell 20 is oriented upwards and provided with a projection 14 extending obliquely backwards and downwards, which corresponds with an appropriate recess, particularly groove 13, on the forward sole end. The groove 13, in association with the projection 14, is open obliquely forwards and upwards. In this way the forward end of the sole 12 can be engaged on the projection 14 of the support shell 20. The support of the shoe is otherwise effected via the bracket 11 on the retainer hook 6.

Stepping into the described binding is extremely simple. The user need merely move the forward sole end in a forward direction into the support shell 20, until contact is made. Then the said hooking configuration is produced between the projection 14 and the complementary recess 13. At the same time it is ensured that the bracket 11 integrated with the sole is located in position, i.e. in association with the retainer hook 6, in such a way that, when the shoe is lowered on to the binding housing forward end section 1, the bracket 11 acts on the pin-like projection 8 in the way described above. The retainer hook 6, released by the resilient members 5, is then pushed into a position in which it engages over the bracket 11 integrated with the sole. Then the shoe is supported from all sides. At the same time however the shoe can be pivoted via the joint-like connection between bracket 11 on the one hand and retainer hook 6 on the other hand relative to the ski cover surface, a permanent contact being ensured between the shoe and the ski cover surface via the support shell 20 and the flexor 10. This contact, existing in every pivotal position of the shoe, considerably increases the sense of power transmission and ski control.

Instead of the bracket 11, of the flat strip type, a pin-like pivotal axis may also be provided. The retainer hook 6 is then also adapted in a corresponding way.

The support shell 20 is in the form of an integral extension of the binding housing, and is in fact relatively thin-walled, in order thereby not to impair the action of the flexor 10.

As can also be seen from FIGS. 1–3, the guide ribs 19 are interrupted in the area of action 21 of the retainer hook 6 or in the accommodating area of the bracket 11 integrated with the sole. The corresponding incision 24 is open in a roughly trapezoidal shape upwards seen in side view. The complementary guide grooves 23 on the underside of the sole of the shoe 16 belonging to the binding (see FIG. 2) each have a filling 22 corresponding to the incision 24; i.e. the filling 22 in use defines so to speak a partial section of the respectively associated rib 19.

The trapezoidal contour of the incision 24 and filling 22 enables defined access into the binding with exact positioning of the bracket 11 relative to the retaining hook 6. In this case it should be noted that the support shell 20 is extremely thin-walled and correspondingly flexible. In this case exact positioning of the bracket 11 is not always ensured. Assistance is given with this problem by the configuration described above of guide rib 19 and guide groove 23.

All features disclosed in the application documents are claimed as essential to the invention, where they are new individually or in combination in relation to prior art.

LIST OF REFERENCE NUMBERS

1. forward end section of the binding housing
2. rear end section of the binding housing
3. actuating device clamp cable
4. actuating device clamp lever
5. resilient member
6. retainer hook
7. cover
8. retainer member (pin-like projection)
9. retainer member (leaf spring)
10. flexor
11. bracket
12. sole
13. groove
14. projection
15. cross-country, particularly skating binding
16. ski shoe
17. access
18. incision
19. guide rib
20. support shell

I claim:

1. A cross-country ski binding and shoe combination comprising:

a shoe having a bottom sole thereon, the bottom sole comprising forward and rearward sections extending along a common longitudinal axis;

a binding adapted to attach to a ski, the binding lockingly receiving the forward sole section;

a bracket mounted on the forward sole section transverse to the longitudinal axis;

a retainer hook mounted on the binding and having forward and rearward movement between a release position and a closed position, in the closed position the retainer hook extends over and engages the bracket on the sole to form a pivotal connection;

a resilient member operatively mounted between the binding and the retainer hook, the resilient member biasing the retainer hook toward the closed position;

an actuating device coupled with the retainer hook that moves the retainer hook out of the closed position and into the release position against the bias of the resilient member; and a retaining member that retains the retainer hook in its release position until the retaining member is urged out of retaining engagement with the retainer hook by downward pressure applied by the bracket upon the retaining member, whereupon the retainer hook is released and automatically moves into the closed position.

2. The combination of claim 1 wherein the retaining member comprises an upwardly tensioned leaf spring having a free end that rests on a lower horizontal leg of the retainer hook.

3. The combination of claim 2 wherein an upwardly projecting pin is mounted on the leaf spring and registered with the bracket so that when the shoe is received in the binding the bracket forces the leaf spring downwardly such that the free end of the leaf spring is no longer supported by the lower horizontal leg of the retainer hook and the retaining member is released and automatically moves forward into the closed position due to the bias of the resilient member.

4. The combination of claim 3 wherein the binding has a flexible support shell adapted to mount on the ski, and the shell having a forward end which is supported by a flexor interposed between the ski and the forward end of the binding.

5. The combination of claim 4 wherein the forward sole section has a groove thereon and the support shell has a corresponding hooking member thereon that engages the groove and thereby positions the forward sole section with resect to the support shell.

6. The combination of claim 5 wherein the hooking member on the forward end of the support shell comprises a projection extending obliquely backward and downward, said projection mating with the groove on the forward sole section so as to hook the forward sole section to the support shell.

7. The combination of claim 6 wherein the binding has a binding housing and the support shell is an integral extension of the binding housing.

8. The combination of claim 1 wherein the actuating device comprises a clamp cable engaging the retainer hook and a clamp lever mounted on the ski that applies tension to the clamp cable.

9. The combination of claim 8 wherein the binding has a longitudinal axis and the clamp lever is pivotally mounted on the binding housing rearwardly of the retainer hook, the clamp lever having a pivot axis extending transversely to the longitudinal axis of the binding.

10. The combination of claim 9 wherein the clamp lever is L-shaped and has a short leg and a long leg joined at a corner area, the clamp cable being connected to the clamp lever in the corner area, the pivot axis being located at the free end of the short leg and the longer leg being directed backwardly from the pivot axis.

11. The combination of claim 1 wherein the binding is elongated and has a longitudinal axis, an upper side, and includes two spaced apart and parallel guide ribs extending longitudinally thereon and projecting from the upper side of the binding and wherein corresponding guide grooves are provided on the underside of the sole of the shoe; the guide ribs being interrupted adjacent to the retainer hook so as to form a guide groove that extends traversely across the elongated binding; the forward section of the sole having a filling portion protruding therefrom; that inserts to insert into the transverse guide groove of the binding.

12. The combination according to claim 11 wherein the filling portion and the transverse guide groove both have a trapezoidal-shaped cross-section in the longitudinal direction of the shoe and the binding, respectively.

* * * * *

UNITED STATES PATENT AND TRADEMARK OFFICE

CERTIFICATE OF CORRECTION

PATENT NO. : 5,992,873
DATED : November 30, 1999
INVENTOR(S) : HAUGLIN, Bernt-Otto It is certified that error appears in the above-identified patent and that said Letters Patent is hereby corrected as shown below:

In column 6, line 25 please delete "resect" and insert — respect —.

Signed and Sealed this

Thirtieth Day of May, 2000

*Attest:*

Q. TODD DICKINSON

*Attesting Officer*

*Director of Patents and Trademarks*